United States Patent [19]

Gradwohl

[11] Patent Number: 4,982,557

[45] Date of Patent: Jan. 8, 1991

[54] DEVICE FOR SMOOTHING OUT AND PRESSING TOGETHER THE FREE PROJECTING END EXTENDING OVER THE FILLING MATERIAL OF FILLED SACKS

[75] Inventor: Adolf Gradwohl, Gleisdorf, Austria

[73] Assignee: Binder & Co. Aktiengesellschaft, Gleisdorf, Austria

[21] Appl. No.: 423,009

[22] Filed: Oct. 18, 1989

[30] Foreign Application Priority Data

Nov. 25, 1988 [AT] Austria ..... 2902/88

[51] Int. Cl.[5] ..... B65B 7/02

[52] U.S. Cl. ..... 53/371; 53/378; 493/258; 493/259

[58] Field of Search ..... 53/273, 289, 371, 378, 53/379, 565, 570, 573; 156/226; 493/255, 257, 258, 259

[56] References Cited

U.S. PATENT DOCUMENTS

| | | | |
|---|---|---|---|
| 2,243,805 | 5/1941 | Knapp | 53/371 |
| 2,940,236 | 6/1960 | Conti | 53/379 |
| 3,167,897 | 2/1965 | Hopkins et al. | 53/371 |
| 3,755,986 | 9/1973 | Hudson | 53/378 |
| 4,078,358 | 3/1978 | Henderson | 53/573 X |

*Primary Examiner*—Robert L. Spruill
*Assistant Examiner*—Linda B. Johnson
*Attorney, Agent, or Firm*—Kurt Kelman

[57] ABSTRACT

A device for smoothing out and pressing together the free projecting end extending over the filling material of filled sacks, said sacks comprising side walls which are inwardly folded and there being two movable pairs of fingers engaging in the sack in the plane of the opened sack or a plane being parallel to said plane as well as a plane being lateral to said plane, whereby said fingers of each of said pair of fingers are arranged at a distance in the transverse direction of the sack opening and two rods or knives are arranged, said rods or knives being movable against each other and are extendable from the outer side of the sack between the fingers of each pair of fingers engaging in the sack, and, if necessary, on both sides of a closable loading funnel of a sack filling station. In order to secure a perfect smoothing out of possible folds in the projecting end of the sack, it is intended that the fingers of each pair of fingers engaging in the sack are arranged eccentrically on disks rotatable against each other.

7 Claims, 5 Drawing Sheets

DEVICE FOR SMOOTHING OUT AND PRESSING TOGETHER THE FREE PROJECTING END EXTENDING OVER THE FILLING MATERIAL OF FILLED SACKS

BACKGROUND OF THE INVENTION (1) Field of the invention

The invention refers to a device for smoothing out and pressing together the free projecting end extending over the filling material of filled sacks, said sacks comprising side walls which are inwardly folded and there being two movable pairs of fingers engaging in the sack in the plane of the opened sack or a plane being parallel to said plane as well as a plane being lateral to said plane, whereby said fingers of each of said pair of fingers are arranged at a distance in the transverse direction of the sack opening and two rods or knives are arranged, said rods or knives being movable against each other and are extendable from the outer side of the sack between the fingers of each pair of fingers engaging in the sack, and, if necessary, on both sides of a closable loading funnel of a sack filling station.

(2) Description of the Prior Art

In presently known inventions the fingers of each pair of fingers, after engaging in the sack, are moved against the wall of the sack together, whereby both pairs of fingers are moved in directions running oppositely one to each other. Thus an extension of the projecting end of the filled sack occurs, whereinafter the knives are moved through the fingers causing the inward fold in both side walls to be produced.

Here, however, the disadvantage arises that the fingers of each pair of fingers in the transverse direction of the sack opening or in the direction of the side walls of the sack are arranged too closely to each other in order to ensure sufficiently strong folds in the side walls in the projecting end of the sack. Thus it can happen that a fold in the area extending into the folded side walls, in particular where wider sacks are concerned, is not smoothed out properly and during the subsequent pressing together of the front and back side of the projecting end of the sack crushing folds might occur, which cause considerable problems when closing the sacks, especially when the sacks are sown or sealed.

SUMMARY OF THE INVENTION

It is the object of the invention to avoid aforementioned disadvantages and to propose a device of the above kind which guarantees a secure smoothing out of the projecting end of the sack.

In accordance with the invention this is achieved in that the finger of each pair of fingers engaging in the sack are arranged eccentrically on disks movable in opposite directions.

This measure enables the engagement of the fingers in the area around the corners of the sack opening and by the respective turning of the fingers to smooth out the sack in the complete area around the corners, so that all folds are reliably smoothed out.

In accordance with a further feature of the invention, the fingers engaging in the sack may be arranged as triangular thin board or metal sheet.

This allows the front and the reverse side of the sack to be closed to be moved very closely to each other solely by the movement of the fingers and thus to bring said sides into a very favourable position for the closing, whereby an exact guidance of the sack's walls by the fingers occurs during the production of the folds in the transverse walls.

A preferable arrangement of the invention may provide that each of the fingers engaging in the sack may be rotatable through an angle of 180°, preferably 270°, whereby the final position of the fingers of each pair should be parallel to each other and have the minimum distance between each other.

This allows the fingers of each pair to move in such a manner that during the rotation of the disks holding said fingers, said fingers at first increase their distance to each other in the transverse direction of the sack opening and thus stretch the sack, subsequently said fingers remain in the final position in which said fingers of said pair of fingers have a distance to each other which allows the knives to move comfortably between them, whereby the side walls are folded and the front and reverse side of the sack are moved very closely to each other. This enables suitable clamping devices to get hold of the free section of the projecting end of the sack, whereinafter the sack may be closed by either sowing or sealing.

It may be further intended that the disks carrying the fingers are torsionally connected with gears, said gears combing each other of which one is connected with a drive.

Thus it is secured that the fingers are taken along free of slippages rotating against each other, so that a highly precise production of the side folds in the transverse walls of the projecting end of a filled sack as well as the best possible preparation of said sack for closing is ensured.

A preferable arrangement of the invention may provide that a cylinder-piston arrangement is provided, said cylinder-piston arrangement being driven by a pressure media and said arrangement driving the disks holding the fingers or the gears torsionally connected to said disks.

This enables the adjustment of the acceleration of the fingers to the respective circumstances and allows the careful treatment of the sacks.

BRIEF DESCRIPTION OF THE DRAWING

The invention is now described by the drawing in detail.

DETAILED DESCRIPTION OF THE PREFERRED EMBODIMENTS

Figure 1:
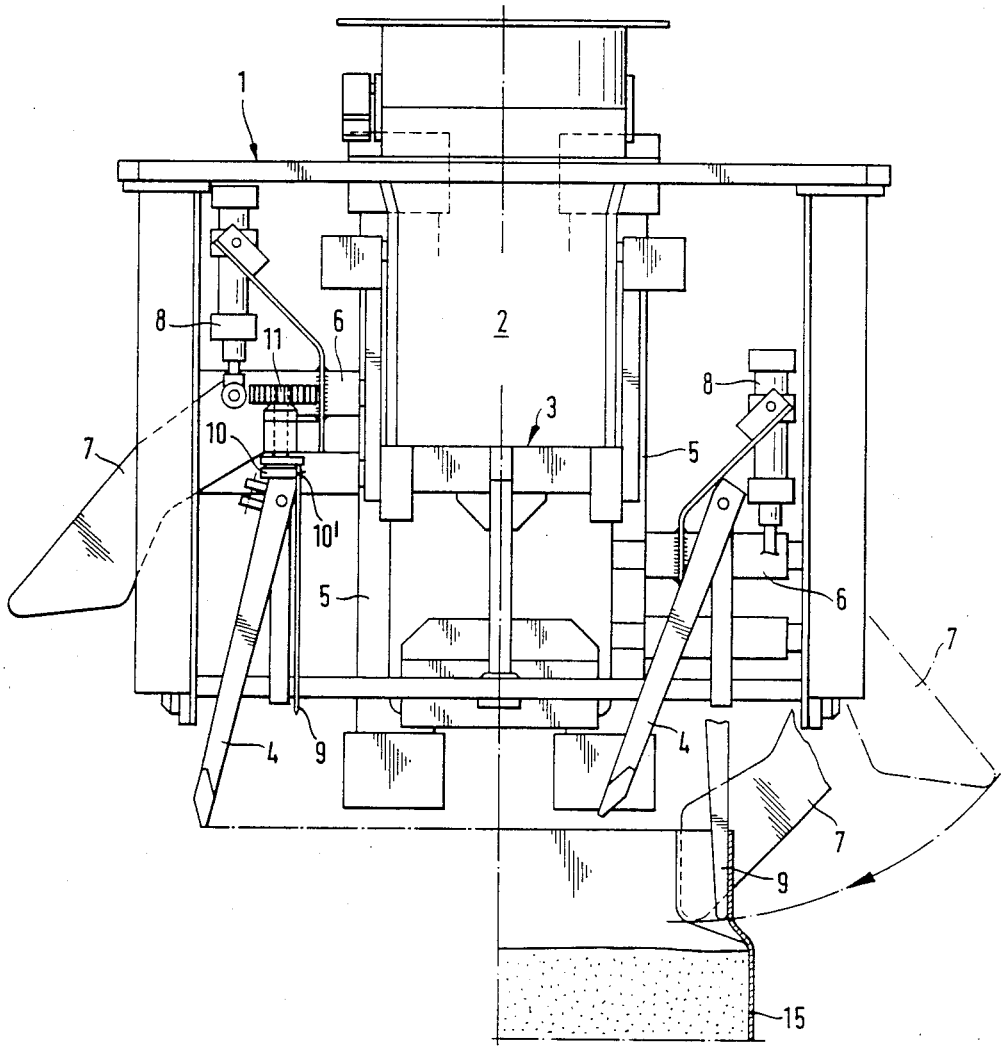
FIG. 1 and 2 show a sack filling station with the device according to the invention, whereby the left half of FIG. 1 shows the resting position and the right half of FIG. 1 shows the working position with an engagement in a sack and FIGS. 3 to 5 schematically show the device according to the invention in various phases of the work cycle from a top view.
Figure 2:
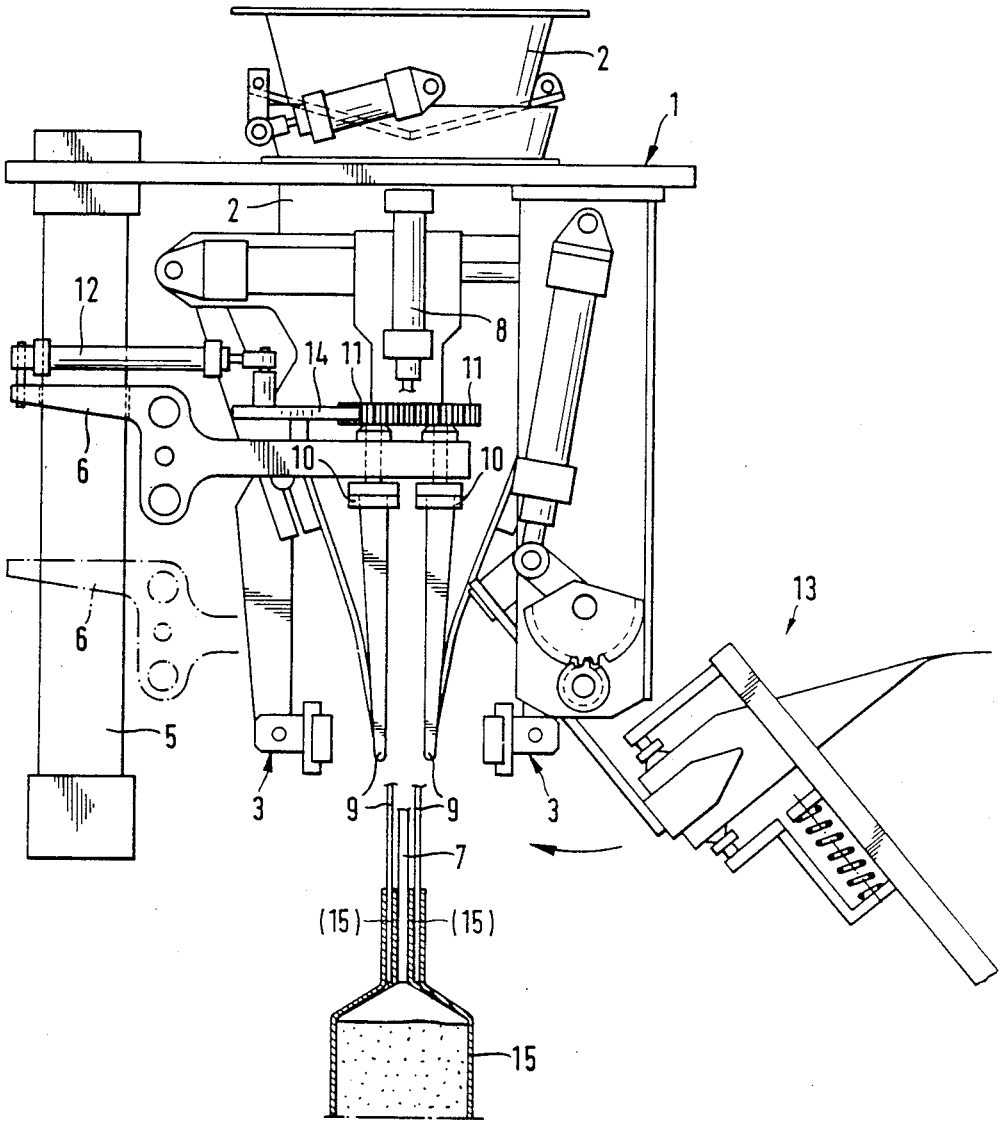

Frame 1 of the sack filling station comprises in the known manner a closable loading funnel 2 with a clamping device 3 plus sack spreader 4. A sledge 6 is held movably on columns 5 of frame on which two knives 7 are held swivelably, said knives being movable by the cylinder-piston devices 8. Furthermore, sledge 6 comprises drives formed by the cylinder-piston devices 12, said cylinder-piston devices serving for activating fingers 9, 9' to be engaged in the sack opening.

Said fingers 9,9' are arranged in form of a relatively thin plate and are substantially triangular. On their one end these fingers 9 are attached to the surface area of a disk 10, said disk being rotatable, whereby the disk has a flattening 10' in the connecting area with the finger.

Every disk 10 is torsionally connected with gear 11, whereby gears 11 of a pair of fingers 9 comb each other. One of said gears 11 of a pair of fingers 9,9' combs toothed quadrant 14 to which a cylinder-piston arrangement 12 acts upon eccentrically, said arrangement being supported by sledge 6.

Furthermore, frame 1 additionally holds a sack delivery device 13, said device enabling the delivery of empty sacks from a stack lying on the side to a closable loading funnel 2.

Knives 7 and the two pairs of fingers 9,9' are essential for the invention, said fingers engaging in the opened sack 15 in the area of the projecting end of the sack located over the filling material when sledge 6 is in the lower position.

Figure 3:
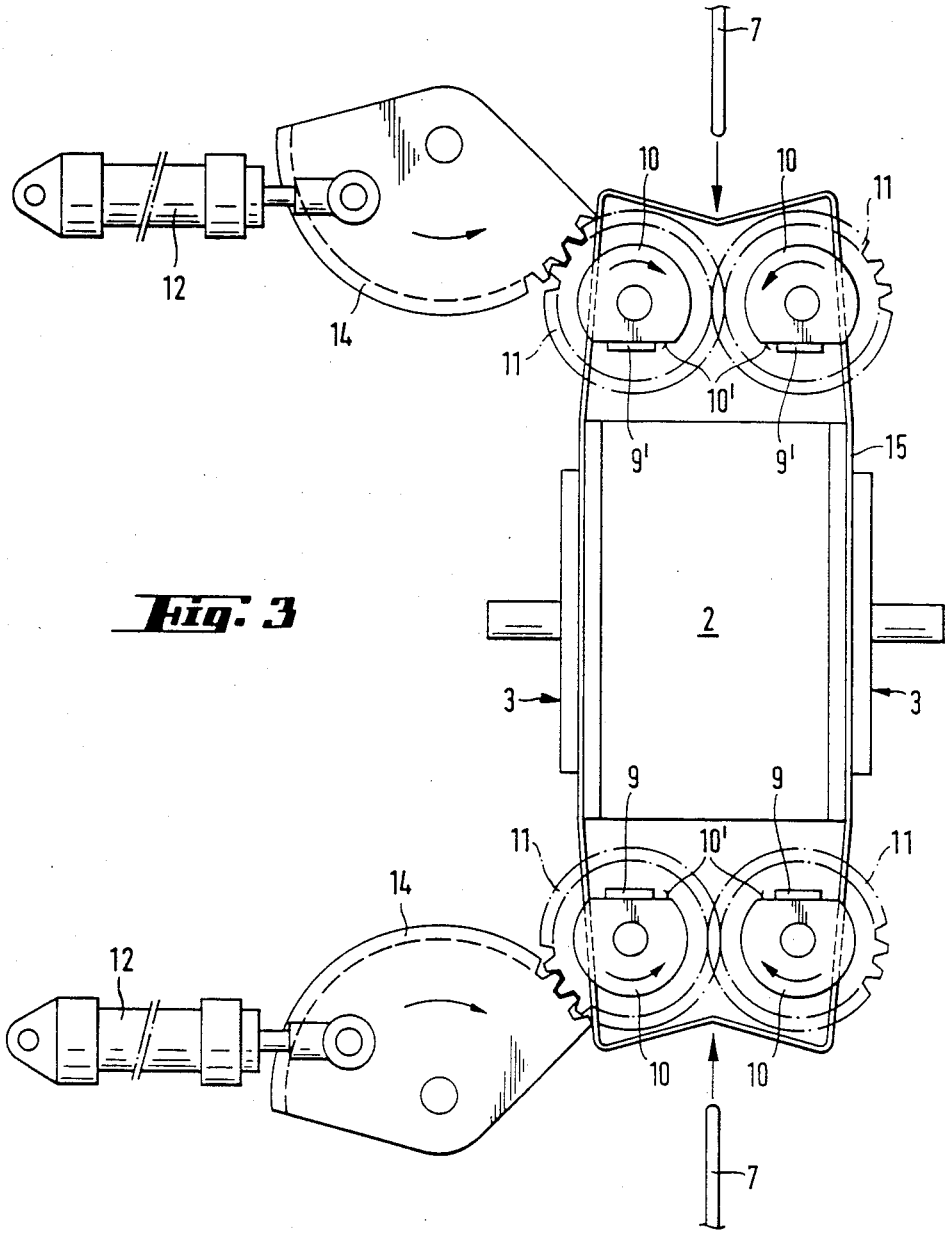

After engagement of the pairs of fingers 9,9' into the sack opening, said fingers 9,9' and the knives 7 take up the position according to FIG. 3, whereby sack 15 is still held by closable loading funnel 2 and clamping device 3. After introduction of fingers 9,9' into sack 15, the clamping between the closable loading funnel 2 and clamping device 3 is loosened and the filled sack falls onto the support not described here. At the same time both pairs of fingers 9 are moved in opposite directions by the cylinder-piston arrangements 12, whereby the closing of the closable loading funnel 2 is initiated.

Figure 4:
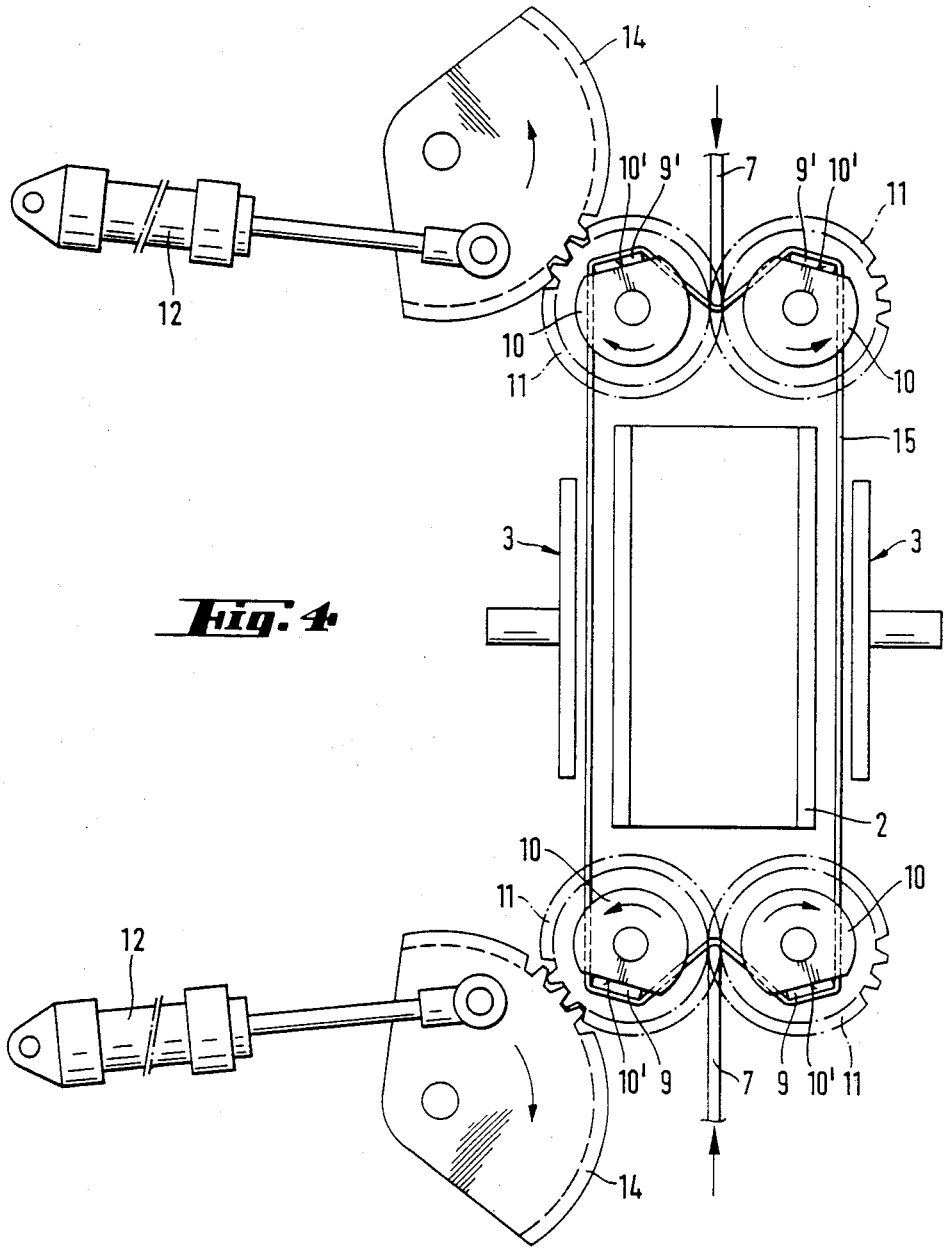

Thereby, fingers 9,9' are rotated in the direction toward the front and reverse wall respectively of sack 15 and get into contact with said sack, whereby possible folds in the walls of the sacks are smoothed out. At the same time both knives 7 are moved against each other and begin to press the folds in the side walls of the sack, as can be seen in FIG. 4., said fig. showing an intermediate position of fingers 9,9' and knives 7.

Figure 5:
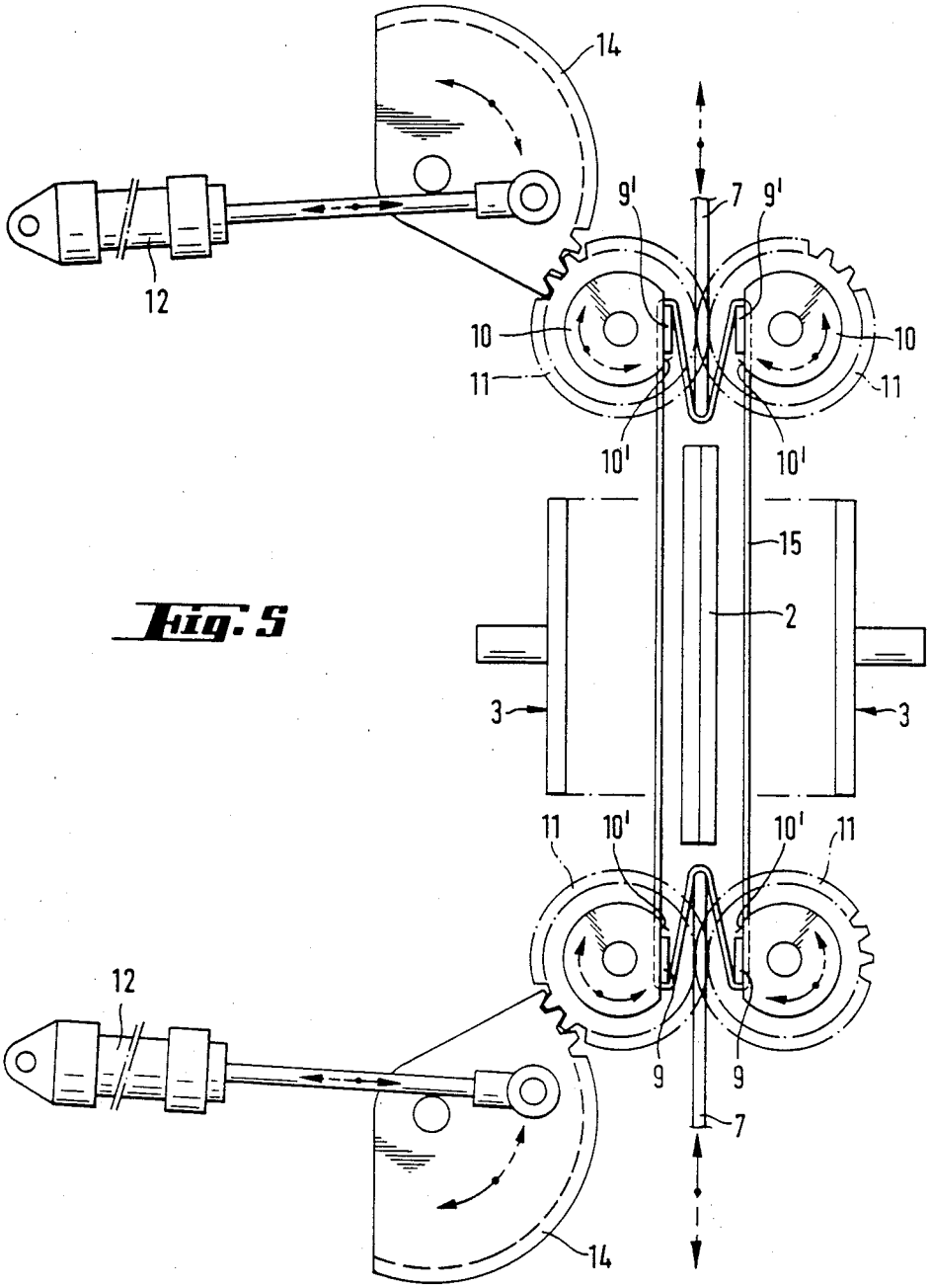

During the continued rotation of fingers 9,9', said fingers move along the side walls, whereby knives 7 are moved even more against each other and further press the folds of the side walls. As can be seen in the position outlined in FIG. 5, both fingers 9,9' of each pair of fingers are arranged parallel to each other and have the minimum distance between each other, whereby knives 7 engage through fingers 9,9' of each pair of fingers.

After reaching the final position of fingers 9,9' and knives 7, sledge 6 is moved up again and knives and fingers are brought back to the starting position.

What is claimed is:

1. A device for smoothing out and pressing together a free end of a sack having an opening extending in a plane and an axis extending perpendicularly to said plane, the sack containing a filling material and the free end comprising side walls folded inwardly towards the axis and projecting beyond the filling material, which device comprises (a) two pairs of fingers movable in planes extending in, or parallel to, the plane of the sack opening and perpendicularly to the plane of the sack opening, the fingers extending in the direction of the axis for engaging the sack opening, the fingers of each pair being spaced from each other in a direction extending transversely to the axis, (b) two rods or knives movable towards each other from outside the sack and displaceable between the fingers of each pair engaging the sack opening, and (c) two disks corresponding to each pair of fingers, said two disks rotatable in opposite directions about axes of rotation extending substantially parallel to the axis of the sack, the fingers of each pair being eccentrically arranged on a respective one of the rotatable disks.

2. The device of claim 1, further comprising a sack loading funnel for charging the filling material through the sack opening, the rods or knives being arranged at respective sides of the funnel.

3. The device of claim 1, wherein the fingers are constituted by thin plates or metal sheets of triangular shape.

4. The device of claim 1, wherein each finger is rotatable about an axis of rotation extending substantially parallel to the axes of rotation of the disks by an angle of at least 180° to an end position wherein the fingers of each pair extend parallel to each other at a minimum spacing.

5. The device of claim 4, wherein the angle is about 270°.

6. The device of claim 1, further comprising two meshing gears, a respective one of the rotatable disks being non-rotatably mounted on a respective one of the gears, and a drive connected to one of the gears.

7. The device of claim 6, wherein the drive comprises a cylinder-piston arrangement operated by a pressure medium.

* * * * *